United States Patent [19]

Carter

[11] 3,990,617

[45] Nov. 9, 1976

[54] BELT RADIO CLIP

[76] Inventor: Gerald T. Carter, 7940 - 20th Ave. SW., Jenison, Mich. 49428

[22] Filed: Feb. 3, 1976

[21] Appl. No.: 654,972

Related U.S. Application Data

[63] Continuation of Ser. No. 499,481, Aug. 22, 1974, abandoned.

[52] U.S. Cl. ..... 224/5 H; 224/3; 224/26 R

[51] Int. Cl.[2] ..... A45F 5/00

[58] Field of Search ..... 224/26 R, 26 B, 5 R, 224/5 A, 5 B, 5 H, 5 E, 5 D, 2 B, 3, 2 C, 2 D

[56] References Cited

UNITED STATES PATENTS

| | | | |
|---|---|---|---|
| 1,059,187 | 4/1913 | McKee | 224/5 A UX |
| 1,321,960 | 11/1919 | Wheat | 224/5 H UX |
| 3,326,433 | 6/1967 | Koch | 224/26 R |
| 3,631,994 | 1/1972 | Mackzum | 224/26 R |

*Primary Examiner*—L. J. Paperner
*Assistant Examiner*—Jerold M. Forsberg
*Attorney, Agent, or Firm*—Price, Heneveld, Huizenga & Cooper

[57] ABSTRACT

A clip-on carrying device for portable personal radios, particularly a radio of the two-way type conventionally used by police officers, firemen and the like. The carrying device includes a first radio receiving portion to which is attached an elongated belt receiving member having a hook-like portion formed thereon to prevent accidental removal of the clip from the belt. The radio receiving portion frictionally engages the outer case of the radio to securely hold the radio therein yet allowing easy removal of the radio when desired.

1 Claim, 4 Drawing Figures

BELT RADIO CLIP

This is a continuation of application Ser. No. 499,481, filed Aug. 22, 1974, now abandoned.

BACKGROUND OF THE INVENTION

Personal two-way radio devices, particularly those of the type used by policemen, firemen and like emergency-oriented personnel have become increasingly popular in recent years. Typically, communications are maintained with a central dispatcher or other personnel by means of a communications setup mounted within a vehicle. When leaving the vehicle, however, lines of communications are broken. Accordingly, personal two-way radios have become highly desirable for use by such individuals to maintain communications at all times. Such personal radios are generally adapted for fastening on the belt of the individual when he is out of the vehicle and while he is in the vehicle, the radio is adapted to plug into a vehicle-mounted unit to connect with the conventional communications setup. Such personal radios conventionally include rechargeable batteries which, when operated in the vehicle, are recharged so that they are ready for use when removed.

Typically, a leather or vinyl case has been used to encase the radio when the user is not in the vehicle. These cases are relatively expensive, extremely bulky and difficult to work with. Much difficulty has been experienced in being able to transfer the radio quickly from case to vehicle and vice versa. The radio, when in the case, often interferes with an officers freedom of movement. The most important drawback, perhaps, is the fact that radios are oftened dropped in "active" situations damaging them severely. When one considers that the price of a radio of this type is typically in excess of $600.00, and often as much as $1,000.00, the need for a more reliable carrying device is readily appreciated.

SUMMARY OF THE INVENTION

The belt radio clip of the present invention overcomes the deficiencies of the prior art holders. The holder is low in cost, virtually maintenance-free, is easily attached to the belt of the user and will not fall off the belt or release the radio in use. Basically, the carrying device of the invention includes a radio embracing first member having a plurality of walls defining generally a rectangular opening to receive the radio and frictionally engage its outer case. A second clip-like member secured to one of the walls of the first member has a pair of spaced apart leg portions one of which is fixed to one of the walls of the first member. The legs are connected to each other at the top to define a belt receiving channel. The lower extremity of the outer leg extends downwardly below the lower surface of the walls and terminates in an upwardly and outwardly directed hook-like portion which fits over the lower surface of the belt. The spacing between the lower surfaces of the walls and the hook-like portion defines an entrance opening into the belt receiving channel.

The many objects and advantages of the invention will become readily apparent to those skilled in the art from a consideration of the following detailed description of the preferred embodiment when read in conjunction with the accompanying drawings.

DISCRIPTION OF THE PREFERRED EMBODIMENT

Figure 1:
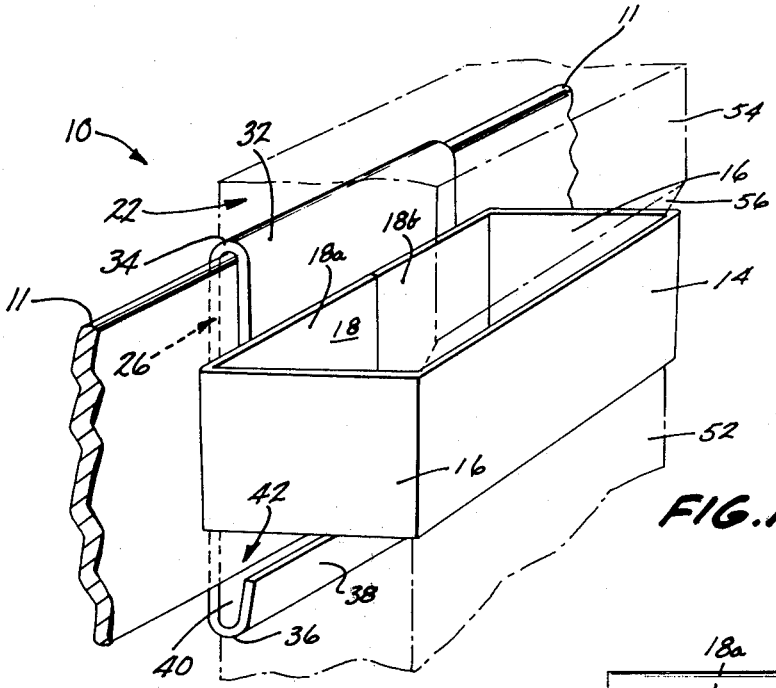
FIG. 1 is a perspective view of the belt radio clip of the invention.
Figure 2:
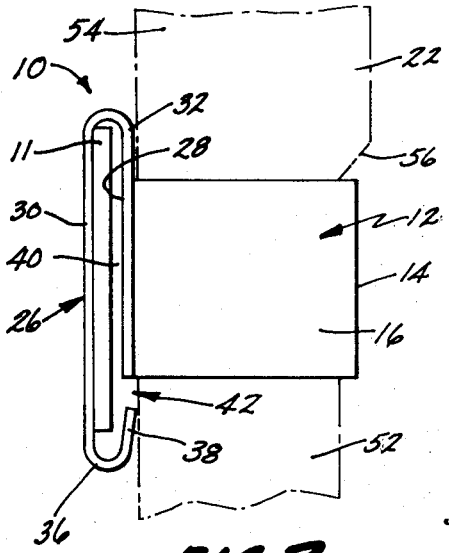
FIG. 2 is a side elevational view of the clip shown in FIG. 1.
Figure 3:
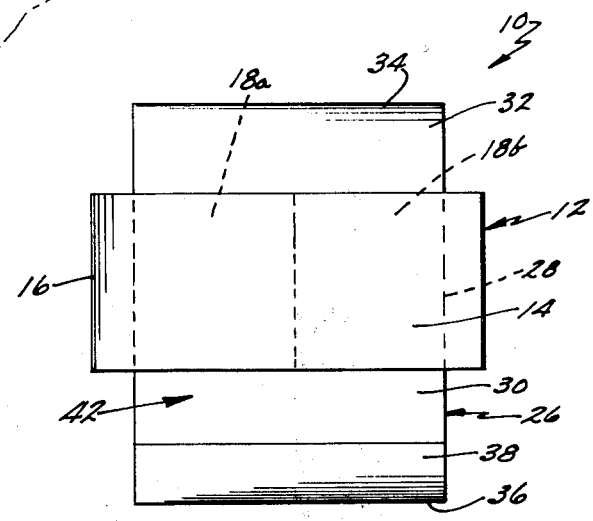
FIG. 3 is a front elevational view.

The radio carrying apparatus of the present invention designated generally by the numeral 10 is adapted for attachment to a belt 11. The carrying apparatus includes a first radio embracing member 12 having a front wall 14, side walls 16 and back wall 18 generally defining a rectangular opening into which a radio, shown in phantom and designated by the numeral 22, is readily insertable and from which it is readily removable. Embracing member 12 is formed from a strip of metallic sheet stock the ends thereof generally designated by the numerals 18a and 18b folded toward each other to cooperatively form rear wall 18. The sheet stock may be for example 20 gage stainless steel although other materials and thicknesses may be utilized with equal facility.

Figure 4:
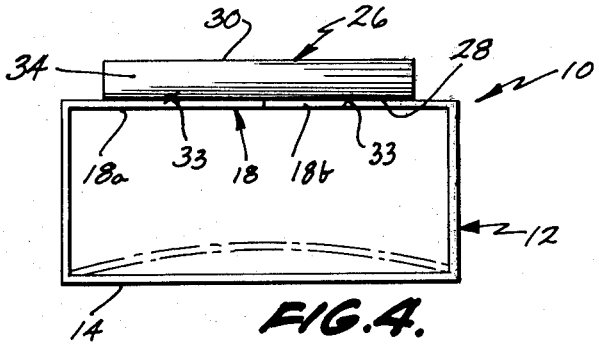
FIG. 4 is a top plan view of the belt radio clip.

The second clip-like belt engaging member 26 includes a first or front leg portion 28 and a spaced apart second leg portion 30. The second member is similarly formed of metallic sheet stock. Rear walls 18a and 18b are fitted against the flat planar surface 32 of the first leg portion 28 where they are secured as by a weld 33 (FIG. 4). The lower surface of wall 18 is formed by ends 18a and 18b generally flush with the lower most end of first leg portion 28. Leg 28 extends upwardly a slight distance beyond the top surface of rear wall 18 where a web 34 is formed connecting legs 28 and 30 and maintaining relative spacing therebetween. Leg 30 extends downwardly generally parallel to leg 28 where, at its lowermost extremity, a generally U-shaped hook-like portion 36 is formed. A side 38 of hook-like portion 36 extends generally upwardly, preferably at a slight angle, toward a plane defined by a line extending downwardly from leg 28 and back wall 18. The space between the top of side 38 and the bottom of the walls defining the radio embracing first member 12 forms an entrance opening 42 into a belt receiving channel 40 formed between legs 28 and 30 of the second member.

The length of channel 40 between web 34 and the bottom-inner surfaces of hook-like portion 36 corresponds generally to the width of a belt 11 to which the carrying device is to be attached. Radio embracing portion 12 is located intermediate the web and hook portion and extends outwardly from leg 28 generally perpendicular to the width of the belt. When attached to the belt the radio embracing portion does not bind against the user as contrasted to prior art holders which extend above or below the belt width, which can cause discomfort to the user.

The carrying device is preferably coated with some type of resilient material. A coating of Nylon to about 0.010 inches in thickness applied as by the fluidized bed coating process has been found satisfactory. The Nylon coating prevents scratching or marring of the surface of the radio and additionally, cooperatively acts with the radio case to provide sufficient friction to hold the radio in place.

A typical radio construction utilized with the clip of the invention is generally about 7 to 8 inches long having a width of 2½ inches and a thickness of about 1½ inches. The lower most end 52 of radio 22 generally has a dimension slightly less than the uppermost portion 54 thereby forming a slight lip or ridge 56 between the top and the bottom portions. When a radio 22 is inserted in the carrying device, there is sufficient resiliency in walls 14 and 16 forming the radio embracing portion 12 to allow the passage of any slight protrusions on the lowermost portion of the radio. The radio is inserted from the top into the rectangular opening until the lip 56 abuts the top surface of the walls defining the radio embracing portion.

As shown in FIG. 4,the apparatus is readily adaptable to accommodate a radio of differing size. Front wall 14 is resiliently deformable as indicated by the dotted line 14a such that a radio having somewhat smaller dimensions may be installed within the carrying device in a similar manner and will remain therein by the frictional engagement between the bowed front wall 14*a* and the outer case of the radio.

In use, the carrying device of the invention is simply hooked over the belt of the user such that the belt is positioned between legs 28 and 30 of the second member 26. Preferably, the length of channel 40 formed between the two leg portions 28 and 30 of the clip is slightly greater than the width of the belt 11. To position the carrying apparatus on a belt 11, the belt is introduced through opening 42 into channel 40 and legs 28 and 30, are slid down along the belt until the belt enters into the hook-like portion 36 at the bottom thereof. The carrying device is then securely fastened to the belt and will not fall off during use. Normally, when in a vehicle, the individual removes the radio from the carrying device plugging it into the fixed unit. Because of its small size, the carrying device remaining on his belt does not at all inconvenience the user. When the user leaves his vehicle, the radio is removed from the vehicle mounted unit and is simply inserted through the rectangular opening. The lower portion 52 of the radio fits through opening until the top surfaces of the walls thereof come into contact with lip 56. The radio is then securely held within the clip by means of the frictional engagement of the Nylon coated walls 14, 16 and 18 thereby requiring a positive action for removal.

Those skilled in the art will immediately appreciate that the carrying device of the present invention is extremely simple in construction, relatively easy to assemble, conveniently mountable on the belt of the user and further, that it will positively retain the radio therein while at the same time allowing relatively easy removal. The disadvantages of the prior art systems as bulkiness, expense and maintenance are completely eliminated by the present invention as those skilled in the art will readily appreciate. Those so skilled will also recognize that modifications may be made to the invention and it is intended that equivalent arrangements be covered unless the following claims, by their wording, expressly state otherwise.

The embodiments of the invention in which an exclusive property or privelege is claimed are defined as follows:

1. A carrying device for a radio receiver and transmitter comprising: a radio embracing rectangular loop member having a front wall, a back wall and a pair of end walls forming a vertical aperture for closely and firmly but slidably engaging a radio receiver; a belt anchor member, said belt anchor member being formed to define a generally flattened loop shaped channel extending horizontally therethrough between a pair of generally parallel walls and having a closed top and of a height and width to closely seat around a belt; the height of the walls of said loop member being less than the height of said belt anchor member; one of said walls of said belt anchor member being rigidly secured to said rear wall of said loop member; the lower end of the other of said walls of said anchor member being reversely bent to form a leg extending upwardly toward and generally beneath said one wall of said belt anchor member; said leg having a free end spaced from and below the lower end of said one wall of said belt anchor member and in cooperation therewith defining a horizontally opening belt receiving aperture below said loop member of a vertical width approximately that of the thickness of a belt and intermediate the top and bottom of said channel whereby a belt slidably introduced into the channel through the belt receiving aperture will be trapped, preventing the device from being inadvertently released from the belt.

* * * * *